United States Patent [19]

Maillefer

[11] 3,948,462

[45] Apr. 6, 1976

[54] CABLE-WINDING MACHINE

[75] Inventor: Charles Maillefer, Renens, Switzerland

[73] Assignee: Maillefer S.A., Switzerland

[22] Filed: May 2, 1975

[21] Appl. No.: 574,241

[30] Foreign Application Priority Data

May 2, 1974 Switzerland ..... 5994/74

[52] U.S. Cl...... 242/158 R; 242/158.2; 242/158.4 R

[51] Int. Cl.[2] ..... B65H 57/28

[58] Field of Search..... 242/158 R, 158.2, 158.4 R

[56] References Cited

UNITED STATES PATENTS 3,106,504 10/1963 Carter ..... 242/158 R X 3,715,084 2/1973 Weiss ..... 242/158.2 X

FOREIGN PATENTS OR APPLICATIONS 836,412 6/1960 United Kingdom..... 242/158.4 R

*Primary Examiner*—Richard E. Aegerter
*Assistant Examiner*—Charles E. Phillips
*Attorney, Agent, or Firm*—Stevens, Davis, Miller & Mosher

[57] ABSTRACT

A cable-winding machine resting upon a foundation and having two uprights supporting two drum-supports respectively, a crosspiece connecting the uprights at their ends and a traverse mechanism movable along the crosspiece. Cooperative movement of the uprights and the traverse mechanism keeps the deflection of the cable to be wound at a desired level.

7 Claims, 3 Drawing Figures

CABLE-WINDING MACHINE

This invention relates to a cable-winding machine resting upon a foundation and comprising two uprights, a crosspiece connecting the uprights at their upper ends, two drum-supports borne respectively by the uprights, and a traverse mechanism, each upright having rolling means at its lower end, the axes of the drum-supports being parallel, and the crosspiece containing means for moving one of the uprights with respect to the crosspiece in a direction parallel to the aforementioned axes and means for controlling movements of the traverse mechanism along the crosspiece.

Various improvements have been made in recent years in winding-machines intended for the automatic of winding of large-diameter cable, e.g., cable which is several centimeters in diameter, on drums. This development has taken place in successive steps which have made possible certain improvements in the reliability of the installations, their ease of control, and their maximum performance. Thus it has been possible to construct so-called "gantry" winding-machines capable of winding cable on drums having cheeks three meters or more in diameter.

However, these various detail improvements have led to various structural solutions, none of which constitutes an optimum solution. Thus in certain of the known winding-machines, the crosspiece connecting the uprights is disposed at the top of the latter, which makes it somewhat easier to put the drums in place in that a space is kept free near the ground in front and in back of the winding-machine. To obtain this advantage, however, it has been necessary to equip these winding-machines with a traverse mechanism suspended from the crosspiece. This presents serious structural difficulties in the case of large-diameter drums and cable, for traverse mechanisms suspended from the crosspiece must be capable of withstanding severe strain, thus necessitating a very massive and rigid construction for their means of suspension. This strain results either from shocks to which the mechanism may be subjected when the drums are put in place or from torsional stress exerted by the cable on the members that guide it.

In other instances, the traverse mechanism constitutes an apparatus independent of the winding-machine proper. It comprises an upright integral with a carriage moving on the ground in front of the winding-machine. This upright may be built rigidly enough to withstand the strain. However, this arrangement involves difficulties in installing the machine, for it is necessary to construct a perfectly flat support area in which four rails, strictly parallel and situated at the same level, must be embedded. Any deviation in alignment or level between the rails of the traverse mechanism and those of the uprights of the winding-machine brings about winding defects or the risk of a breakdown.

It is the object of this invention to provide still a further improvement in cable-winding machines, and more particularly in those intended for winding cable on large drums, thanks to a novel structural arrangement which avoids the drawbacks mentioned above and represents an improvement on the known winding-machine as regards not only their construction and their installation but also their possibilities of use.

To this end, in the cable-winding machine according to the present invention, the traverse mechanism comprises a rigid upright and further rolling means, the rigid upright being connected to the crosspiece and supported at its lower end on the foundation by means of the further rolling means.

A preferred embodiment of the invention will now be described in detail with reference to the accompanying drawings, in which.

Figure 2:
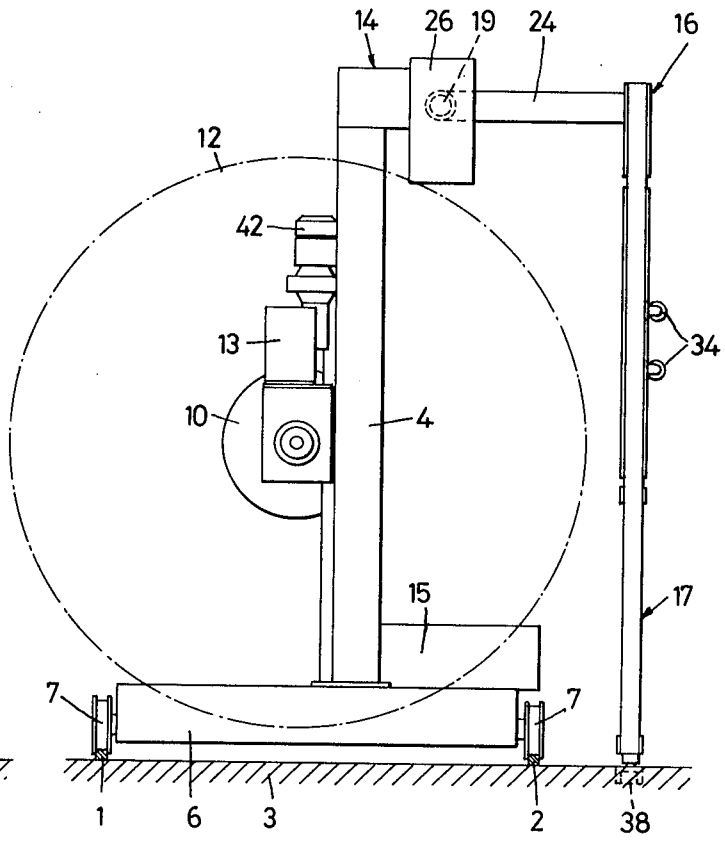
FIG. 2 is a side elevation.

The winding-machine illustrated in the drawing is mounted on two parallel rails 1 and 2 which will be bedded on a horizontal foundation 3 preferably consisting of a cement or concrete slab which extends about one to two meters beyond the rails 1 and 2 on at least one side. Each of two uprights 4 and 5 is borne by a carriage 6 provided with an axle, mounted at the ends of which are rollers 7 running on the rails 1 and 2. Each upright 4 and 5 is constructed in the form of a sectional beam and carries a spindle-support 8, 9 sliding vertically on the side of the upright and actuated by an electric motor 42 (FIG. 2) which enables the positions of spinders 8*a*, 9*a* to be adjusted in height. The spindles 8*a* and 9*a* are parallel to one another, and the two motors 42 are controlled in such a way that the spindles remain coaxial. One of the spindles 8*a* carries a driving plate 10, while the other 9*a* simply comprises a centering stud 11. A drum 12 is shown in dot-dash lines in a position where it is coupled to the plate 10 and raised up for operation. The spindle 9*a* is rotated by a motor and a gear-train housed in a gearbox 13 (shown diagrammatically) which is integral with the spindle-support 8 sliding on the upright 4.

A top crosspiece 14 is rigidly secured to the upper end of the upright 4 and guides connecting means (not shown) situated at the upper end of the upright 5. These connecting means may, for example, consist of a slide-and-roller device. Furthermore, a rotary screw actuatable by a motor housed in a gearbox at the end of the crosspiece 14 enables the displacement at will of the entire upright 5 parallel to the common axis of the spindles 8*a* and 9*a* in order, for example, to engage or release the drum 12. Each of the associated 7 associated with the upright 5 then runs on a respective one of the rails 1 and 2. Moreover, the carriage 6 associated with the upright 4 bears a mechanism housing 15 which contains in particular a motor and a gear-train or a belt connecting the axle of the carriage 6 to that motor. Hence the operation of that motor causes the entire winding-machine to be moved along the rails 1 and 2.

Figure 3:
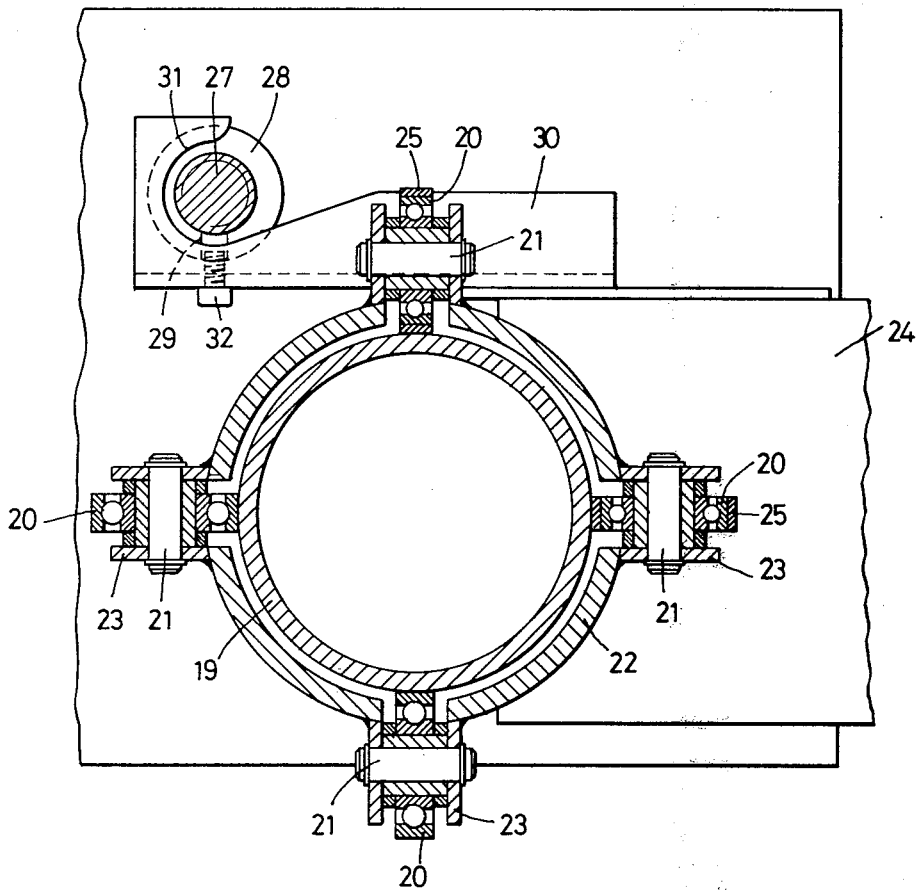
FIG. 3 is a partial section, on a larger scale, taken on the line III—III of FIG. 1.

To complete the winding-machine, a traverse mechanism, designated as a whole by the reference numeral 16, is provided. The mechanism 16 comprises an upright 17 in the form of a rigid beam of angular shape likewise constructed of metal sections. At its lower end, the upright 17 bears a roller 18, the axis of which is parallel to the shafts of the carriage 6, and which is able to run on the support slab 3 of the rails 1 and 2 in a direction parallel to those rails. A horizontal arm situated at the upper end of the vertical part of the upright 17 is guided by a joint which links it to the crosspiece 14. For that purpose, as shown in FIG. 3, the crosspiece 14 contains a cylindrical shaft 19 which is fixed and extends from one end of the crosspiece 14 to the other, parallel to the common axis of the spindles 8*a* and 9*a*. The outer cylindrical surface of the shaft 19 serves as a guiding and running surface for two groups of four ball bearings 20. The four bearings of each group are disposed at 90° from one another about the shaft 19, and their axes 21 are borne by arcuate support elements 22 equipped with flanges 23, the support elements 22 being secured between the two parallel sides 24 of the upper horizontal arm of the upright 17. To provide for the adjustment of the bearings 20 with respect to the cylindrical surface of the shift 19, two bearings 20 of each of the two groups are equipped with adjusting collars 25 which may be turned at the time of assembly in order to regulate the clearances. Each bearing 20 is intended to roll along a generatrix of the shaft 19 during operation of the traverse mechanism 16 with respect to the crosspiece 14. The traverse mechanism 16 is driven by a control motor housed in the gearbox 26 at the end of the crosspiece 14. The control motor with speed-reducer drives the rotary screw 27 mounted above and slightly offset with respect to the shaft 19. Engaged on the screw 27 is a cylindrical nut 28 having a radial bore 29 (FIG. 3). To effect the connection between the nut 28 and the traverse mechanism 16, and to render the nut 28 integral with the mechanism 16 so as to communicate its movement to it, the end of the upper horizontal arm of the upright 17 closest to the shaft 19 bears a U-section 30, the two sidewalls of which are disposed vertically, and the central portion of which is secured between the sides 24 and extends horizontally. The two sidewalls of the U-section 30 exhibit an arcuate indentation 31 which, as may be seen in FIG. 3, opens out upwardly and to the right, and the radius of which is sufficient to allow the screw 27 to pass but small enough to retain the nut 28. Finally, a screw 3 screwed into the bottom of the section 30 and engaged in the bore 29 keeps the nut 28 from rotating with the screw 27.

As will be seen, the arrangement described above simultaneously ensures the resistance of the traverse mechanism 16 to strain and the necessary flexibility to allow operation meeting all service conditions. The roller 18 of the traverse mechanism 16 can rest directly upon the foundation 3. Even if the foundation 3 is somewhat uneven with respect to the rails 1 and 2 when the winding-machine is installed, this unevenness has no effect on the operation of the traverse mechanism 16. The sliding joint formed by the bearing composed of the elements 20 to 23, on the one hand, and by the shaft 19, on the other hand, allows the entire tranverse mechanism 16 to position itself freely about the axis of that shaft. The bearings 20 may describe helical paths along the shaft 19 when the roller 18 moves parallel to the rails 1 and 2 if the foundation 3 is uneven. Moreover, the connection described above between the nut 28 and the upright 17 allows these slight movements to take place without hindering the driving conditions. For example, a vertical movement of the roller 18 on the order of 2 cm. with respect to the rollers 7 causes the edges of the indentation 31 and the screw 32 to move only 1-2 mm. at the most with respect to the nut 28. The latter does not undergo any stress liable to be transmitted to the screw 27 and to hinder its operation. Moreover, it remains connected to the section 30.

Owing to its design, the traverse mechanism 16 is able to withstand considerable strain. It rests directly on the foundation 3 and does not transmit any torsional stress to the crosspiece 14. Thus the strength of the crosspiece can be calculated without having to take such stresses into account.

If need be, the upright 17 may be lifted so as completely to free the space between the winding-machine and the production line. In that case, the section 30 and the screw 32 are completely disengaged from the nut 28.

Furthermore, by virtue of its design, the winding-machine described makes it possible to simplify the construction of the means for guiding the cable. As may be seen particularly in FIG. 1, these guide means consist of a carriage 33 composed of upper and lower rolls 34 and two vertical rolls 35. The frame on which the rolls 34 and 35 are mounted slides in parallel vertical guide members 36 integral with the upright 17. The carriage 33 is borne by chains which pass over pulleys (not shown) situated at the upper ends of the members 36 and from which counterweights are suspended. Thus the carriage 33 as a whole can ascend and descend along the members 36 as the cable is wound on or unwound from the drum 12. The cable-guiding members 34 and 35 are adjustable on the carriage 33 so as to allow the cable the desired play. The construction of the carriage 33 and its adjustment are simpler than those of the guide devices previously used, composed of two long, parallel rolls.

Finally, the design described above broadens the field of possible applications of the winding-machne by allowing in particular its use for winding delicate cables which must not undergo any significant deflection upon leaving the production line. Until now, as a matter of fact, whenever it has been necessary to wind cable which ought not to be subjected to any significant deflection upon leaving the production line, the gantry of the winding-machine has had to be placed at a considerable distance, e.g., more than 7 m., from the end of the line. With the winding-machine described above, however, this requirement is eliminated, and it is possible to place the gantry closer to the end of the production line.

Figure 1:
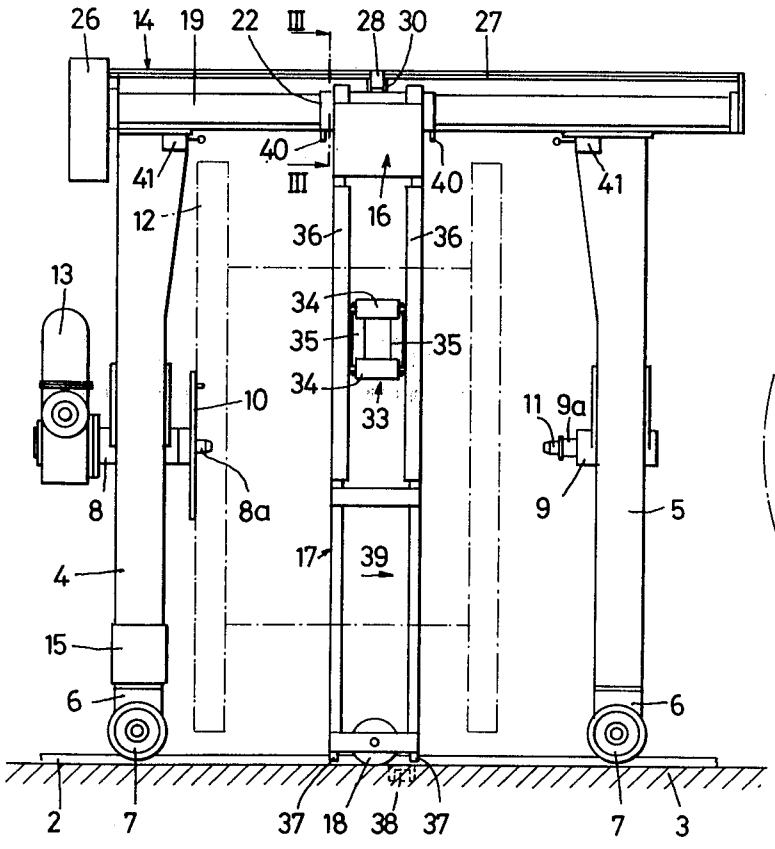
FIG. 1 is a front elevation.

The winding-machine described may, in fact, operate as a self-traversing winding-machine. For that purpose, the upright 17 is equipped with two stroke-limiting members 37, spaced 300 mm. apart, for example, as shown in FIG. 1. A stop element 38 is also embedded in the foundation 3 along the path followed by the members 37. The stroke-limiting members 37 and the stop 38 may be designed in various ways. The members 37 may, for instance, be magnetic proximity detectors, with the stop 38 consisting of a permanent magnet or a part made of low-remanence ferromagnetic material. Other designs are also possible, however. The detectors 37 will be connected into the control circuit of the motor in the housing 15 ensuring rapid movement of the entire winding-machine. The operation of the apparatus as a self-traversing winding-machine will then be as follows:

It shall be assumed, for example, with reference to FIG. 1, that the gantry is fixed and that the traverse mechanism 16, driven by the rotary screw 27, moves from left to right in the direction indicated by an arrow 39. The speed of this movement must be carefully regulated and remain constant so as to ensure uniform winding. When the stroke-limiting member 37 to the left of the upright 17 arrives above the stop 38, it will be actuated, causing the motor which drives the rollers 7 to start up, so that the entire winding-machine will move rapidly from right to left. During that time, the traverse mechanism 16 continues to move from left to right with respect to the uprights 4 and 5 and, consequently, to lay the cable regularly on the drum 12; but as soon as the member 37 to the right of the upright 17 is situated above the stop 38, it is actuated, and the motor controlling the rollers 7 stops. Thus it will be seen that the lateral deviation to which the cable is subjected is limited to the distance between the stroke-limiting members 37. The continuous movement of the traverse mechanism 16, combined with the intermittent movement of the whole winding-machine in the opposite direction, goes on until one of two stops 40 integral with the bearing of the upright 17 comes in contact with or acts in some other manner upon one of two end-to-stroke detectors 41 integral with the uprights 4 and 5, respectively. At the moment when one of the stops 40 acts upon the corresponding detector 41, it causes the direction of rotation of the screw 27 and the control of the motor in the housing 15 to reverse.

The electric control device described above may be produced in several different ways, be means of relays or electronic devices which need not be described in detail here.

It will be noted that the machine described in simple and rigid in construction. It is suitable for receiving cables and drums of very large size and adapts itself to all types of cable, whether stiff or flexible. The same machine can operate equally well in a self-traversing manner, as described above, or in the usual manner where the traverse mechanism moves back and forth from one end of the drum to the other. This requires only the disconnection of the switching members 37. Furthermore, the uprights 4 and 5 mounted on carriages 6 move either together, as a single unit, or separately from one another in order to change the spacing between them. Finally, owing to the joint between the crosspiece 14 and the upright 17, the roller 18 which guides the latter may rest directly upon the foundation 3, even if this foundation is somewhat uneven.

What is claimed is:

1. A cable-winding machine resting upon a foundation and comprising two uprights, a crosspiece connecting said uprights at their upper ends, two drum-supports borne respectively by said uprights, and a traverse mechanism, each said upright having rolling means at its lower end, the axes of said drum-supports being parallel, and said crosspiece containing means for moving one of said uprights with respect to said crosspiece in a direction parallel to said axes and means for controlling movements of said traverse mechanism along said crosspiece, wherein said traverse mechanism comprises a rigid upright and further rolling means, said rigid upright being connected to said crosspiece and supported at its lower end on said foundation by means of said further rolling means.

2. A winding-machine in accordance with claim 1, wherein said rigid upright takes the form of a corner and is linked to said crosspiece by a joint, the axis of said joint being parallel to said drum-support axes.

3. A winding-machine in accordance with claim 2, wherein said crosspiece comprises a fixed cylindrical guide shaft, and said rigid upright bears a guide bearing engaged on said shaft.

4. A winding-machine in accordance with claim 3, wherein said guide bearing comprises two groups of ball bearings having their axes situated in two planes parallel and perpendicular to said shaft and being adapted to roll along a generatrix of said shaft when said traverse mechanism moves parallel to said crosspiece or to follow a helical path along said shaft.

5. A winding-machine in accordance with claim 3, wherein said crosspiece carriers a rotary screw for driving said traverse mechanism, a nut integral in translation with said guide bearing being engaged on said screw.

6. A winding-machine in accordance with claim 5, wherein said nut and said rigid upright are connected by a connecting part in the form of a U-section, said nut being engaged within said U-section, and by a pin integral with said connecting part and connected to said nut for preventing said nut from rotating with said screw.

7. A winding-machine in accordance with claim 1, further comprising a circuit for controlling movements of said winding-machine as a whole, wherein said rigid upright is provided with two stroke-limiting members spaced from one another in a direction parallel to said drum-support axes, a stop element being embedded in said foundation for cooperation with said stroke-limiting members, and said stroke-limiting members being connected into said circuit.

* * * * *